US009018570B2

(12) United States Patent
Child

(10) Patent No.: US 9,018,570 B2
(45) Date of Patent: Apr. 28, 2015

(54) COMBINATORIAL HEATING OF SUBSTRATES BY AN INDUCTIVE PROCESS AND COMBINATORIAL INDEPENDENT HEATING

(75) Inventor: Kent Riley Child, Dublin, CA (US)

(73) Assignee: Intermolecular, Inc., San Jose, CA (US)

( * ) Notice: Subject to any disclaimer, the term of this patent is extended or adjusted under 35 U.S.C. 154(b) by 574 days.

(21) Appl. No.: 13/327,482

(22) Filed: Dec. 15, 2011

(65) Prior Publication Data

US 2013/0153567 A1 Jun. 20, 2013

(51) Int. Cl.
*H05B 6/10* (2006.01)
*H05B 6/06* (2006.01)

(52) U.S. Cl.
CPC . *H05B 6/06* (2013.01); *H05B 6/105* (2013.01)

(58) Field of Classification Search
CPC ..... H05B 6/06; H05B 6/105; H05B 6/10
USPC ..... 219/634, 635, 638, 647, 655, 656, 701, 219/632, 121.43, 121.58, 121.49, 658; 118/723 R
See application file for complete search history.

(56) References Cited

U.S. PATENT DOCUMENTS

| | | | | |
|---|---|---|---|---|
| 6,620,250 | B2 * | 9/2003 | Brezoczky et al. | 118/715 |
| 7,737,385 | B2 * | 6/2010 | Timans et al. | 219/390 |
| 2007/0166133 | A1 * | 7/2007 | Lee et al. | 414/217 |
| 2009/0241836 | A1 | 10/2009 | Ishisaka | |
| 2010/0059182 | A1 * | 3/2010 | Lee et al. | 156/345.52 |
| 2011/0024047 | A1 * | 2/2011 | Nguyen et al. | 156/345.51 |

* cited by examiner

*Primary Examiner* — Dana Ross
*Assistant Examiner* — James Sims, III

(57) ABSTRACT

Induction heating systems and methods for combinatorial heating of a substrate are disclosed. The induction heating system includes a susceptor segmented into multiple regions (e.g., two to 20 regions) that are separated from one another by a reflective channel that is purged with a liquid (e.g., gas or liquid). The induction heating system includes multiple induction coils, each induction coil corresponding to one of the susceptor regions or segments. The distance between each induction coil and the susceptor region can be varied using an independent lift for each region. The relative distance between the coils and the corresponding susceptor regions is used to vary the temperature of a substrate so that different regions of the substrate can be independently heated to different temperatures.

14 Claims, 5 Drawing Sheets

COMBINATORIAL HEATING OF SUBSTRATES BY AN INDUCTIVE PROCESS AND COMBINATORIAL INDEPENDENT HEATING

TECHNICAL FIELD

The present disclosure relates generally to semiconductor manufacturing and in particular to combinatorial and independent heating of substrates by an inductive process.

BACKGROUND

Induction heating is the process of heating an electrically conducting object (usually a metal) by electromagnetic induction, where eddy currents (also called Foucault currents) are generated within the metal and resistance leads to Joule heating of the metal. An induction heater includes an electromagnet through which a high-frequency alternating current (AC) is passed (i.e., an inductive coil coupled to a susceptor), to generate eddy currents in the metal (i.e., the susceptor). The frequency of AC used in induction heating depends on the object size, material type, coupling (between the work coil and the object to be heated) and the penetration depth. Heat may also be generated by magnetic hysteresis losses in materials that have significant relative permeability.

An exemplary prior art susceptor is shown in FIG. 1. As shown in FIG. 1, the prior art susceptors 100 are made of a single piece of material. A single coil is also typically provided and inductively coupled to the single-piece susceptor. The distance between the coil and susceptor can be varied. Current inductive heating systems, however, cannot heat substrates in a segmented pattern or with a single power source with varying heat patterns.

SUMMARY

The following summary of the invention is included in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

According to one aspect of the invention, a method that includes providing a substrate on a susceptor having a plurality of susceptor regions, each susceptor region coupled to an induction coil and separated by a distance; and inductively heating at least one region of a substrate to a first temperature that is different than a temperature of at least one other region of the substrate.

Inductively heating the at least one region of the substrate to the first temperature may include varying the distance between an induction coil and the susceptor region corresponding to region of the substrate heated to achieve the first temperature.

Varying the distance may include lifting the induction coil closer to the susceptor.

The method may also include purging a reflective channel separating the plurality of susceptor regions.

According to another aspect of the invention, an induction heating system is disclosed that includes a chamber comprising a susceptor with at least two susceptor regions; at least two inductor coils, each inductor coil aligned with one of the at least two susceptor regions; and at least two lifts, each lift coupled to one of the at least two inductor coils to independently vary a distance between the one of the at least two inductor coils and the one of the at least two susceptor regions. In some embodiments, number of inductor coils and lifts correspond to the same number of susceptor regions.

The chamber may include at least one reflective surface separating the at least two susceptor regions.

The chamber may include four susceptor regions, four inductor coils and four lifts, each lift corresponding to one of the four inductor coils to vary the distance between the coil and one of the four susceptor regions.

The chamber may include a reflective channel, and fluid may be purged through the reflective channel.

The fluid may be selected from the group consisting of gas and liquid.

The induction heating system may further include at least two power sources, each power source coupled to one of the at least two induction coils.

Each of the at least two induction coils may be independently cooled with liquid.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

DETAILED DESCRIPTION

Figure 1:
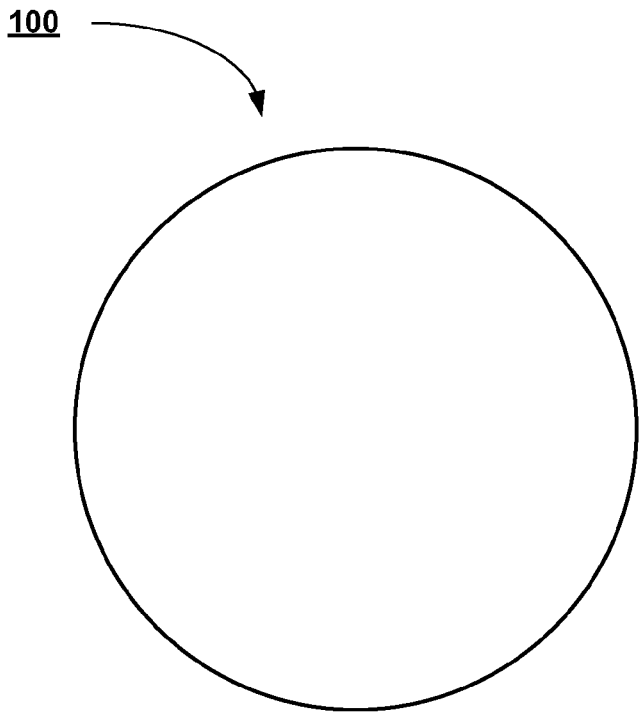
FIG. 1 (PRIOR ART)
FIG. 1 is a schematic diagram of a prior art susceptor plate.

Embodiments of the invention are directed to induction heating systems and methods for combinatorial heating of a substrate. The induction heating system includes a susceptor segmented into multiple regions (e.g., two to 20 regions) that are separated from one another by a reflective channel that is purged with a liquid (e.g., gas or liquid). The induction heating system includes multiple induction coils, each induction coil corresponding to one of the susceptor regions or segments. The distance between each induction coil and the susceptor region can be varied using an independent lift for each region. The relative distance between the coils and the corresponding susceptor regions is used to vary the temperature of a substrate so that different regions of the substrate can be independently heated to different temperatures. By utilizing a purged, reflective channel and segmented heaters, a combinatorial approach can be used to heat a substrate or substrates, using varying and/or independent heat temperatures.

The manufacture of semiconductor devices entails the integration and sequencing of many unit processing steps. As an example, semiconductor manufacturing typically includes a series of processing steps such as cleaning, surface preparation, deposition, patterning, etching, thermal annealing, and other related unit processing steps. The precise sequencing and integration of the unit processing steps enables the formation of functional devices meeting desired performance metrics such as efficiency, power production, and reliability.

As part of the discovery, optimization and qualification of each unit process, it is desirable to be able to i) test different materials, ii) test different processing conditions within each unit process module, iii) test different sequencing and integration of processing modules within an integrated processing tool, iv) test different sequencing of processing tools in executing different process sequence integration flows, and combinations thereof in the manufacture of devices such as semiconductor devices. In particular, there is a need to be able to test i) more than one material, ii) more than one processing condition, iii) more than one sequence of processing conditions, iv) more than one process sequence integration flow, and combinations thereof, collectively known as "combinatorial process sequence integration", on a single substrate without the need of consuming the equivalent number of monolithic substrates per material(s), processing condition(s), sequence(s) of processing conditions, sequence(s) of processes, and combinations thereof. This can greatly improve both the speed and reduce the costs associated with the discovery, implementation, optimization, and qualification of material(s), process(es), and process integration sequence(s) required for manufacturing.

Systems and methods for High Productivity Combinatorial (HPC) processing are described in U.S. Pat. No. 7,544,574 filed on Feb. 10, 2006, U.S. Pat. No. 7,824,935 filed on Jul. 2, 2008, U.S. Pat. No. 7,871,928 filed on May 4, 2009, U.S. Pat. No. 7,902,063 filed on Feb. 10, 2006, and U.S. Pat. No. 7,947,531 filed on Aug. 28, 2009, the entireties of which are all herein incorporated by reference. Systems and methods for HPC processing are further described in U.S. patent application Ser. No. 11/352,077 filed on Feb. 10, 2006, claiming priority from Oct. 15, 2005, U.S. patent application Ser. No. 11/419,174 filed on May 18, 2006, claiming priority from Oct. 15, 2005, U.S. patent application Ser. No. 11/674,132 filed on Feb. 12, 2007, claiming priority from Oct. 15, 2005, and U.S. patent application Ser. No. 11/674,137 filed on Feb. 12, 2007, claiming priority from Oct. 15, 2005, the entireties of which are all herein incorporated by reference.

HPC processing techniques have been successfully adapted to wet chemical processing such as etching, texturing, polishing, cleaning, etc. HPC processing techniques have also been successfully adapted to deposition processes such as sputtering, atomic layer deposition (ALD), and chemical vapor deposition (CVD).

Figure 2:
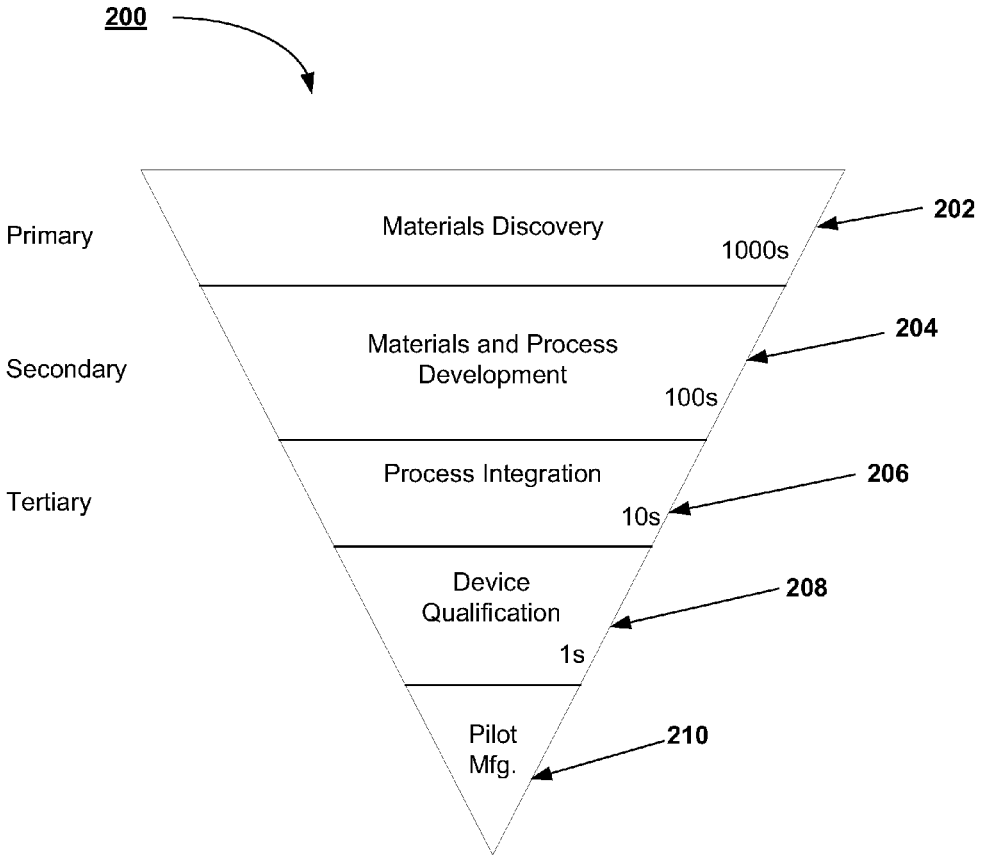
FIG. 2 is a schematic diagram for implementing combinatorial processing and evaluation.

FIG. 2 illustrates a schematic diagram, 200, for implementing combinatorial processing and evaluation using primary, secondary, and tertiary screening. The schematic diagram, 200, illustrates that the relative number of combinatorial processes run with a group of substrates decreases as certain materials and/or processes are selected. Generally, combinatorial processing includes performing a large number of processes during a primary screen, selecting promising candidates from those processes, performing the selected processing during a secondary screen, selecting promising candidates from the secondary screen for a tertiary screen, and so on. In addition, feedback from later stages to earlier stages can be used to refine the success criteria and provide better screening results.

For example, thousands of materials are evaluated during a materials discovery stage, 202. Materials discovery stage, 202, is also known as a primary screening stage performed using primary screening techniques. Primary screening techniques may include dividing substrates into coupons and depositing materials using varied processes. The materials are then evaluated, and promising candidates are advanced to the secondary screen, or materials and process development stage, 204. Evaluation of the materials is performed using metrology tools such as electronic testers and imaging tools (i.e., microscopes).

The materials and process development stage, 204, may evaluate hundreds of materials (i.e., a magnitude smaller than the primary stage) and may focus on the processes used to deposit or develop those materials. Promising materials and processes are again selected, and advanced to the tertiary screen or process integration stage, 206, where tens of materials and/or processes and combinations are evaluated. The tertiary screen or process integration stage, 206, may focus on integrating the selected processes and materials with other processes and materials.

The most promising materials and processes from the tertiary screen are advanced to device qualification, 208. In device qualification, the materials and processes selected are evaluated for high volume manufacturing, which normally is conducted on full substrates within production tools, but need not be conducted in such a manner. The results are evaluated to determine the efficacy of the selected materials and processes. If successful, the use of the screened materials and processes can proceed to pilot manufacturing, 210.

The schematic diagram, 200, is an example of various techniques that may be used to evaluate and select materials and processes for the development of new materials and processes. The descriptions of primary, secondary, etc. screening and the various stages, 202-210, are arbitrary and the stages may overlap, occur out of sequence, be described and be performed in many other ways.

Figure 3:
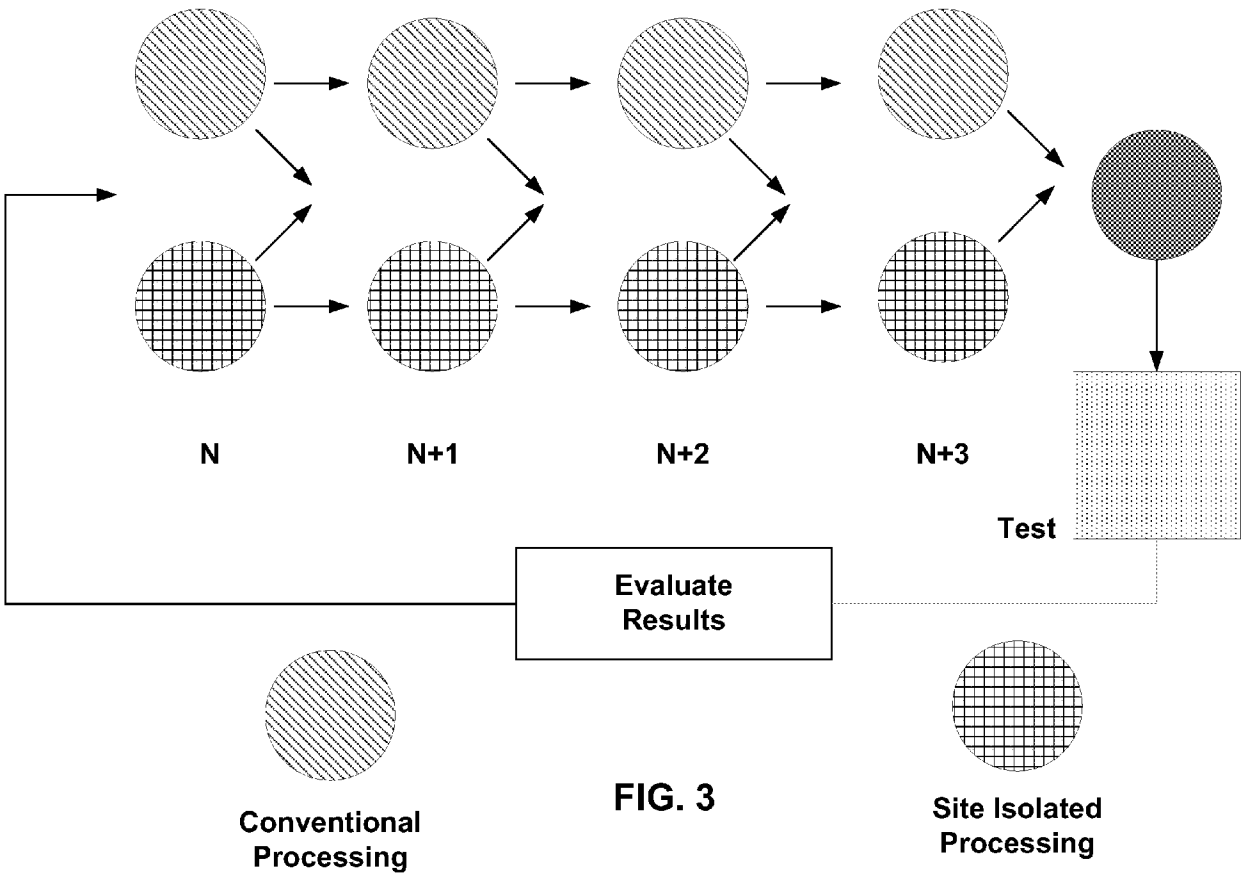
FIG. 3 is a schematic diagram for illustrating various process sequences using combinatorial processing and evaluation.

FIG. 3 is a simplified schematic diagram illustrating a general methodology for combinatorial process sequence integration that includes site isolated processing and/or conventional processing in accordance with one embodiment of the invention. In one embodiment, the substrate is initially processed using conventional process N. In one exemplary embodiment, the substrate is then processed using site isolated process N+1. During site isolated processing, an HPC module may be used, such as the HPC module described in U.S. patent application Ser. No. 11/352,077 filed on Feb. 10, 2006. The substrate can then be processed using site isolated process N+2, and thereafter processed using conventional process N+3. Testing is performed and the results are evaluated. The testing can include physical, chemical, acoustic, magnetic, electrical, optical, etc. tests. From this evaluation, a particular process from the various site isolated processes (e.g. from steps N+1 and N+2) may be selected and fixed so that additional combinatorial process sequence integration may be performed using site isolated processing for either process N or N+3. For example, a next process sequence can include processing the substrate using site isolated process N, conventional processing for processes N+1, N+2, and N+3, with testing performed thereafter.

It should be appreciated that various other combinations of conventional and combinatorial processes can be included in the processing sequence with regard to FIG. 3. That is, the combinatorial process sequence integration can be applied to any desired segments and/or portions of an overall process flow. Characterization, including physical, chemical, acoustic, magnetic, electrical, optical, etc. testing, can be performed after each process operation, and/or series of process operations within the process flow as desired. The feedback provided by the testing is used to select certain materials, processes, process conditions, and process sequences and eliminate others. Furthermore, the above flows can be applied to entire monolithic substrates, or portions of monolithic substrates such as coupons.

Under combinatorial processing operations the processing conditions at different regions can be controlled independently. Consequently, process material amounts, reactant species, processing temperatures, processing times, processing pressures, processing flow rates, processing powers, processing reagent compositions, the rates at which the reactions are quenched, deposition order of process materials, process sequence steps, hardware details, etc., can be varied from region to region on the substrate. Thus, for example, when exploring materials, a processing material delivered to a first and second region can be the same or different. If the processing material delivered to the first region is the same as the processing material delivered to the second region, this processing material can be offered to the first and second regions on the substrate at different concentrations. In addition, the material can be deposited under different processing parameters. Parameters which can be varied include, but are not limited to, process material amounts, reactant species, processing temperatures, processing times, processing pressures, processing flow rates, processing powers, processing reagent compositions, the rates at which the reactions are quenched, atmospheres in which the processes are conducted, an order in which materials are deposited, hardware details of the gas distribution assembly, etc. It should be appreciated that these process parameters are exemplary and not meant to be an exhaustive list as other process parameters commonly used in semiconductor manufacturing may be varied.

Figure 4:
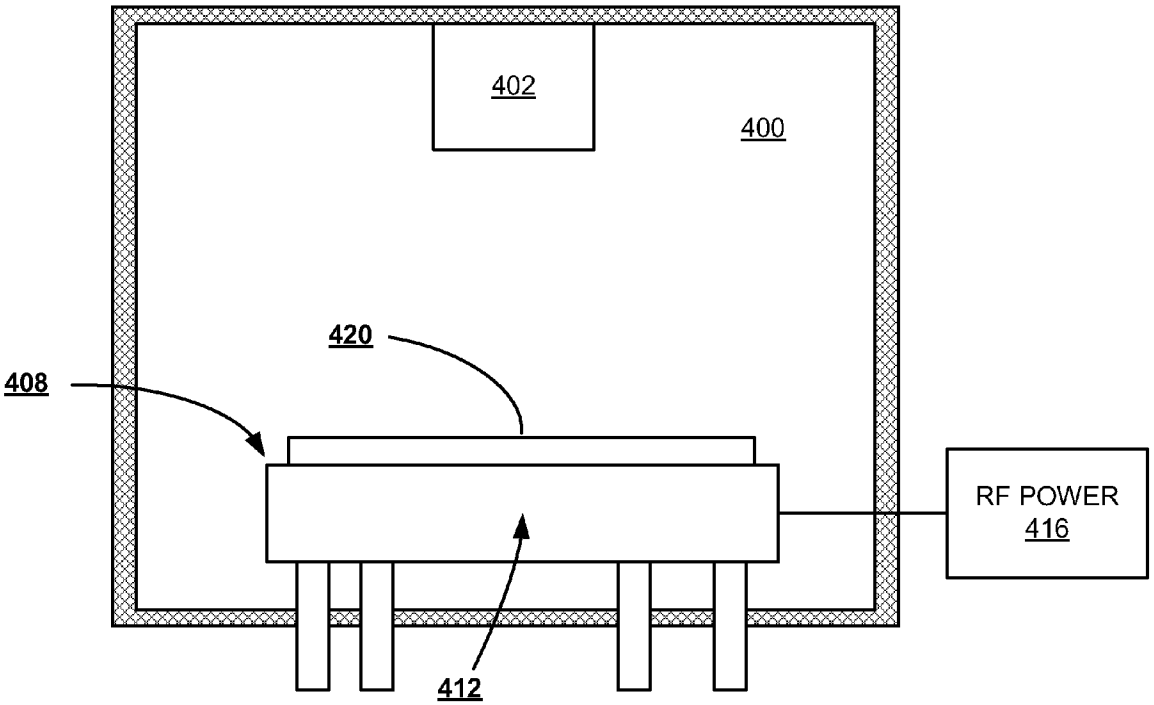
FIG. 4 is a schematic diagram of a process chamber for combinatorial and independent heating of substrates by an inductive process according to some embodiments of the invention.

FIG. 4 is a simplified diagram illustrating an exemplary process chamber 400 of a substrate processing system that can be used for conventional or combinatorial processing. The process chamber may be any type of chamber used in semiconductor processing, such as, for example, a plasma etching reactor, a reactive ion etching (RIE) reactor, an atomic layer deposition (ALD) reactor, a chemical vapor deposition (CVD) reactor, a plasma enhanced CVD (PECVD) reactor, a physical vapor deposition (PVD) reactor, an electron cyclotron resonance (ECR) reactor, a rapid thermal processing (RTP) reactor, an ion implantation system, and the like. The process chamber 400 typically includes a source 402 for performing one of the above processes.

The process chamber 400 also typically includes a substrate support 412. The substrate support 412 illustrated in FIG. 4 includes an induction heating system 408, which includes a RF power source 416, to heat a substrate (or wafer) 420 that is positioned on the substrate support 412. The induction heating system 408 allows for independent and combinatorial heating of different regions of the substrate compared to prior art induction heating systems as described above with reference to FIG. 1. Additional details regarding the induction heating system 408 will be described below with reference to FIGS. 5-6.

Figure 5:
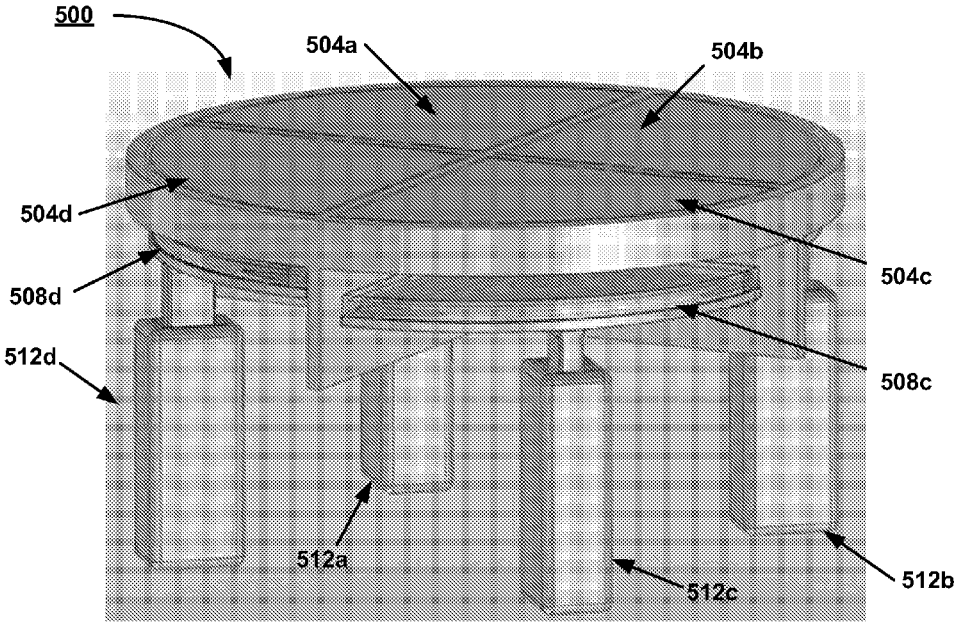
FIG. 5 is a perspective view of a combinatorial and independent inductive heating system according to some embodiments of the invention.
Figure 6:
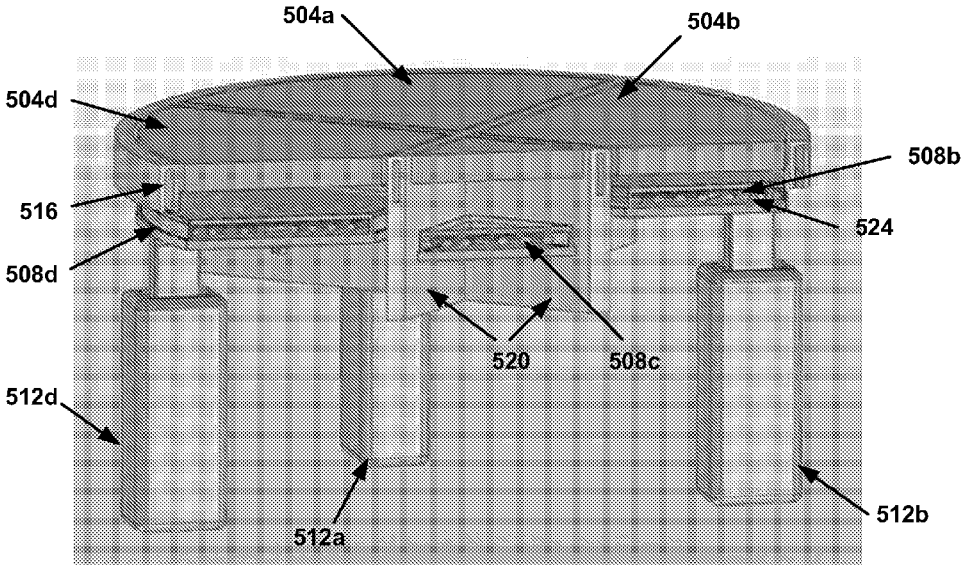
FIG. 6 is a partial cross-sectional view of the combinatorial and independent inductive heating system of FIG. 5 according to some embodiments of the invention.

FIGS. 5 and 6 illustrate the combinatorial and independent induction heating system 408 in accordance with one embodiment of the invention. As shown in FIG. 5, the induction heating system 408 includes a chamber 500 that is segmented to hold a susceptor 504 that is itself segmented into multiple susceptor regions 504*a*, 504*b*, 504*c* and 504*d*. The chamber 508 is configured to hold the multiple susceptor regions 504*a*-504*d* so that the regions can be heated independently as will be described in further detail hereinafter.

The susceptor regions 504*a-d* may be made of any conductive material used as a susceptor material, as known to those skilled in the art, and, in one particular embodiment, the susceptor regions 504*a-d* may be made of graphite coated with silicon carbide.

In some embodiments, the susceptor regions 504*a-d* may be formed by cutting a pattern into a whole susceptor using a laser cutter. It will be appreciated that other methods may be used to segment a whole susceptor into the susceptor regions 504*a-d*.

The induction heating system 408 also includes an induction coil 508, which is divided into four separate coils 508*a*, 508*b*, 508*c* and 508*d*. The respective induction coils 508*a*-508*d* are aligned with the respective susceptor regions 504*a*-504*d* (i.e., induction coil 508*a* is aligned with susceptor region 504*a*, etc.), and the induction coils 508*a*-508*d* are separated from the susceptor regions 504*a*-504*d* by a relative distance.

Each induction coil 508*a*-508*d*, respectively, is coupled to a lift 512*a*-512*d*. The lifts 512*a*-512*d* are configured to independently vary the relative distance between the respective coils 508*a*-508*d* and the susceptor regions 504*a*-504*d*. For example, lift 512*a* is configured to raise or lower the coil 508*a* relative to the susceptor region 504*a*, lift 512*b* is configured to raise or lower the coil 508*b* relative to the susceptor region 504*b*, and so on.

It will be appreciated that because each coil 508*a*-508*d* is coupled to an independent lift, the relative distance between each respective coil 508*a*-508*d* and susceptor region 504*a*-504*d* can be different, as shown in FIG. 6. In FIG. 6, induction coil 508*c* is lower than induction coils 508*d* and 508*b*, and induction coil 508*d* is lower than induction coil 508*b*. It will also be appreciated that the relative distance two or more of the respective coils 508*a*-508*d* and susceptor regions 504*a*-504*d* can be the same.

As described above, the chamber 500 is configured to hold each of the susceptor regions 504*a*-504*d* so that the susceptor regions 504*a*-504*d* are independent. The chamber 500 includes reflective shields 520 that are configured to re-radiate heat away from adjoining susceptor regions 504*a*-504*d*. This allows for each region 504*a*-504*d* to be heat isolated. It will be appreciated that the chamber may be made of any material, and, in some embodiments, the surfaces of the chamber may be plated with gold.

The induction heating system 408 may also include a cooling system. In some embodiments, as shown in FIG. 6, the chamber 500 may include one or more channels 516 through which a fluid or gas may be circulated or purged. The channels 516 may also have one or more reflective surfaces, similar to reflective shields 520. Similarly, the coils 508 may also be cooled by circulating or purging fluid or gas through a channel 524 surrounding the coils 508. It will be appreciated that the cooling system may allow for independent cooling of the coils 508 (i.e., each coil 508 may have an independent channel 524 through which fluid or gas is purged). A common or separate fluid source(es) and pump(s) (not shown) may be coupled to the coils 508 and channels 516 to provide the fluid or gas for purging. It will be appreciated that any fluid or gas that is typically used in semiconductor processing to cool heating systems may be used to purge the channels 516, including, for example, water.

As described above with reference to FIG. 4, the induction heating system 408 may include an RF power source 416. In some embodiments, a single power source 416 may be used to supply power to each of the coils 508*a*-508*d*. In alternative embodiments, each coil 508*a*-508*d* may be coupled to an independent power source so that the power supplied to each coil 508*a*-508*d* may vary.

In FIGS. 5 and 6, the induction heating system 408 includes four susceptor regions 504, four coils 508 and four lifts 512. It will be appreciated, however, that the induction heating system may have less than four or more than four susceptor regions 504, four coils 508 and four lifts 512, and that the induction heating system 408 may have any number of susceptor regions 504, coils 508 and lifts 512, including any value or range of values between about two and about twenty susceptor regions 504, coils 508 and lifts 512.

In operation, power is applied from the one or more power sources 416 to the coils 508*a*-508*d*. The coil induces eddy currents in the susceptor regions 504*a*-504*d*, which cause the susceptor regions 504*a*-504*d* to heat up. Heating in each susceptor region 504*a*-504*d* may be varied by moving the induction coils 508*a*-508*d* closer or farther away from their respective susceptor regions 504*a*-504*d* using the respective independent lifts 512*a*-512*d*. Heat can also be varied individually by utilizing separate power sources to control the power that is supplied to each coil 508*a*-508*d*.

By segmenting the induction heating system 408 into independent regions, as described above, the induction heating system 408 allows for combinatorial heating or selective zone heating of the substrate 420. The substrate 420 can be heated with different localized heat patterns in a controlled fashion or separated into distinct heat zones. For example, as described above, the independent lift 512*a* can be raised to move the coil 508*a* closer to the susceptor region 504*a* (relative to the other susceptor regions 504*b*-*d*), to increase the eddy currents and therefore the heat generated in the susceptor region 504*a*. The temperature in the region of the substrate 420 that is positioned over the susceptor region 504*a* is increased relative to the regions of the substrate 420 that are positioned over the susceptor regions 504*b*-504*d*. In addition, or alternatively, the power supplied to each induction coil 508*a*-508*d* can be increase to raise or lower the temperature of regions of the substrate 420.

The induction heating system 408 shown in FIGS. 5 and 6, therefore, can be configured to generate four independent temperature profiles in the substrate 420 that can be used in combinatorial processing of the substrate 420. It will be appreciated, as described above, that the induction heating system 408 can be configured to generate less than or more than four independent temperature profiles in the substrate 420. In some embodiments, any of the support sections may be separated into distinct heat zones.

The invention has been described in relation to particular examples, which are intended in all respects to be illustrative rather than restrictive. Various aspects and/or components of the described embodiments may be used singly or in any combination. It is intended that the specification and examples be considered as exemplary only, with a true scope and spirit of the invention being indicated by the claims.

What is claimed is:

1. An induction heating system for combinatorial heating of a substrate, the induction heating system comprising:

a processing chamber comprising a susceptor having multiple segments, each segment of the multiple segments comprising a susceptor region, an inductor coil positioned under the susceptor region and connected to an independent power source, and a lift coupled to the inductor coil and operable to vary a distance between the inductor coil and the susceptor region independently from any other of the multiple segments, and reflective shields thermally isolating each of the multiple segments;

a cooling system comprising a plurality of channels, wherein each inductor coil has a different one of the plurality of channels providing independent cooling for that inductor coil.

2. The induction heating system of claim 1, wherein each of the plurality of reflective channels is disposed around a different inductor coil and wherein the cooling system is operable to purge an independent fluid through each of the reflective channels for cooling in a combinatorial manner.

3. The induction heating system of claim 2, wherein the fluid is a liquid or a gas.

4. The induction heating system of claim 3, wherein the fluid is water.

5. The induction heating system of claim 1, wherein the cooling system is operable to simultaneously purge a fluid from a common source through the plurality of reflective channels for cooling in a uniform manner.

6. The induction heating system of claim 5, wherein the fluid is a liquid or a gas.

7. The induction heating system of claim 6, wherein the fluid is water.

8. The induction heating system of claim 1, wherein the chamber comprises between two and twenty segments.

9. The induction heating system of claim 8, wherein the chamber comprises four segments.

10. The induction heating system of claim 1, wherein the chamber further comprises a plurality of reflective shields, each reflective shield in the plurality of reflective shields being located between at least two of the multiple segments and the each reflective shield configured to re-radiate heat away from adjoining segments.

11. The induction heating system of claim 1, wherein the independent power source is a radio frequency (RF) power source.

12. The induction heating system of claim 1, wherein the chamber is plated with gold.

13. The induction heating system of claim 1, wherein the multiple segments are comprised of a conductive material.

14. The induction heating system of claim 1, wherein the multiple segments are comprised of graphite coated with silicon carbide.

* * * * *